US005131629A

United States Patent [19]

Hillhouse

[11] Patent Number: 5,131,629

[45] Date of Patent: Jul. 21, 1992

[54] JACK ADAPTER APPARATUS

[76] Inventor: James A. Hillhouse, 2848 Oak, Oak Groves, Tex. 77619

[21] Appl. No.: 740,974

[22] Filed: Jul. 6, 1991

[51] Int. Cl.[5] ..... B66F 11/00

[52] U.S. Cl. ..... 254/133 R

[58] Field of Search ..... 254/133 R, 134 R, 100, 254/DIG. 1, DIG. 4; 269/274

[56] References Cited

U.S. PATENT DOCUMENTS

| | | | |
|---|---|---|---|
| 38,501 | 5/1863 | Pickard | 254/133 R |
| 136,156 | 2/1873 | Hake | 254/133 R |
| 716,217 | 12/1902 | Glenn | 269/274 |
| 1,266,958 | 5/1918 | Kiriyama | 254/133 R |
| 2,536,550 | 1/1951 | Hughes | 254/133 R |
| 3,213,963 | 10/1965 | Vogt | 248/188.9 |
| 3,300,183 | 1/1967 | Marshall | 254/133 R |
| 3,765,650 | 10/1973 | Eisenhauer | 254/133 R |
| 3,850,409 | 11/1974 | Davis et al. | 254/133 R |
| 4,194,726 | 3/1980 | Hance | 254/133 R |
| 4,846,443 | 7/1989 | Collins et al. | 254/133 R |
| 5,007,607 | 4/1991 | Kim | 248/188.9 |

*Primary Examiner*—Robert C. Watson
*Attorney, Agent, or Firm*—Leon Gilden

[57] ABSTRACT

A generally "S" shaped plate member is arranged for securement to a rod head plate of a rod that is extensibly and telescopingly mounted within a jack cylinder. The plate member is formed of a first plate, a second medial plate, and a third top plate, wherein the third top plate includes clamping structure to secure the third plate relative to the rod head plate.

4 Claims, 4 Drawing Sheets

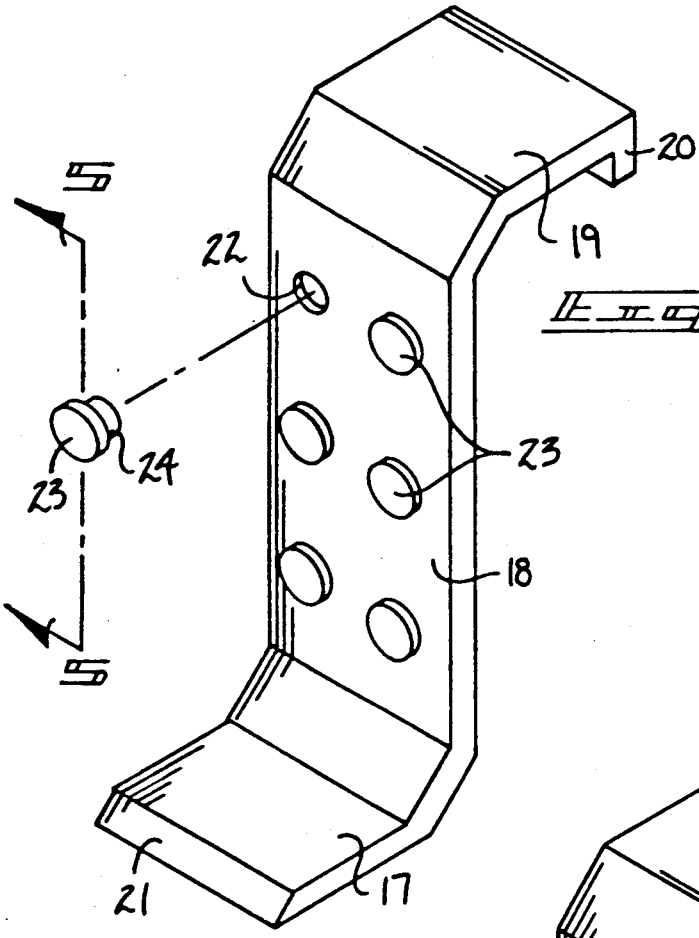
Fig 4
Fig 5
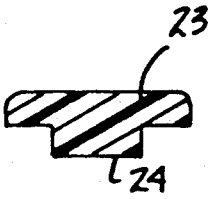
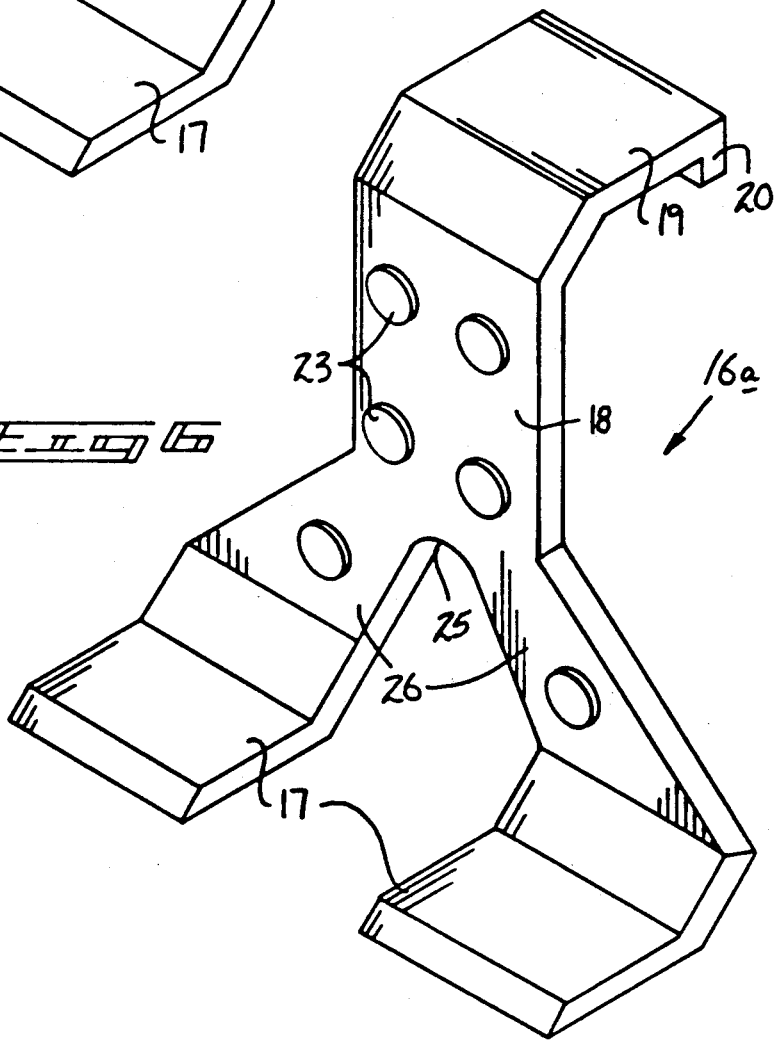
Fig 6

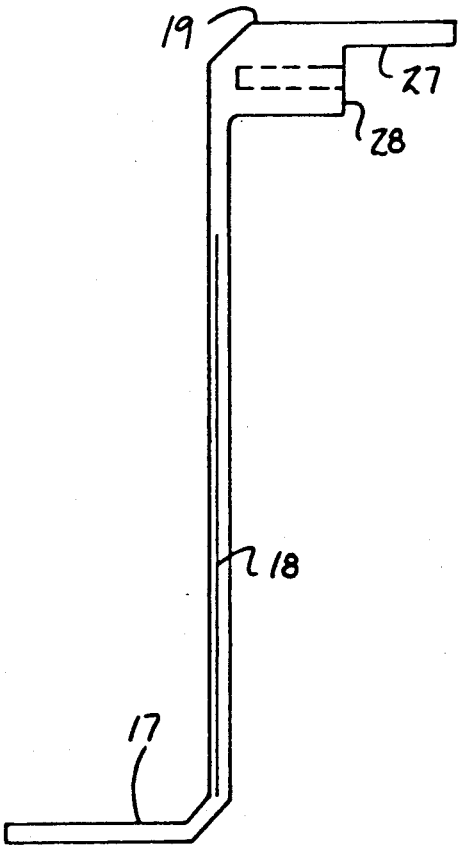
Fig 7
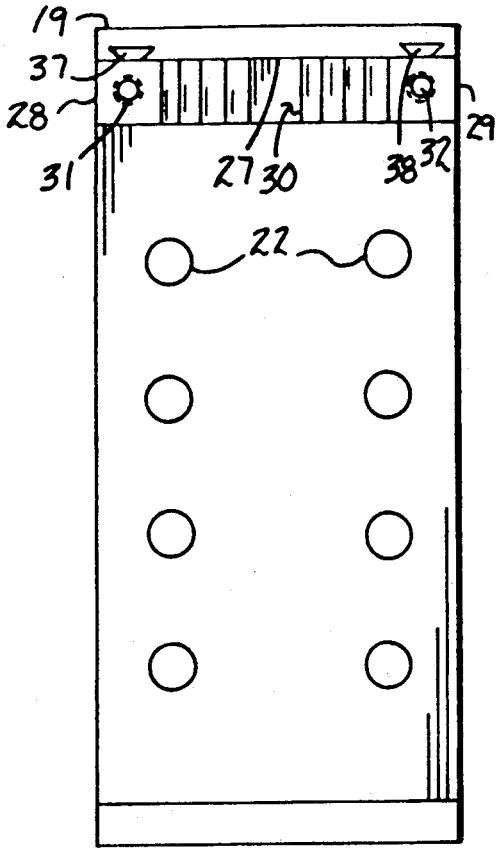
Fig 8
Fig 10
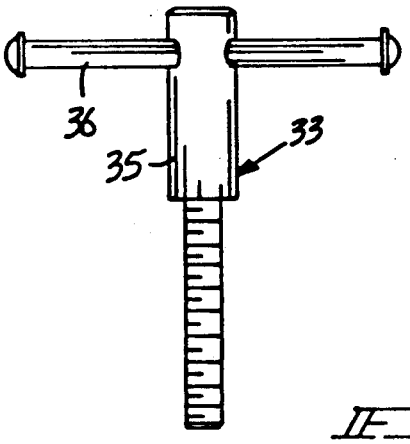
Fig 9
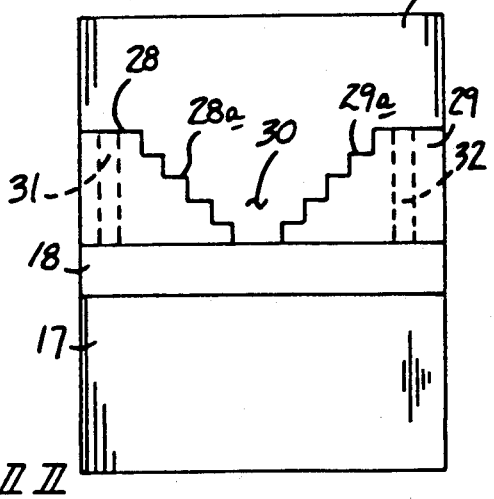
Fig 11
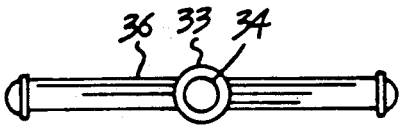

JACK ADAPTER APPARATUS

BACKGROUND OF THE INVENTION

1. Field of the Invention

The field of invention relates to jacking apparatus, and more particularly pertains to a new and improved jack adapter apparatus arranged for mounting to a piston jack to permit a lifting plate positionable relative to a workpiece and permit lifting adjacent a base portion of the jack.

2. Description of the Prior Art

Various jacking arrangements and accessories are utilized in the prior art to provide lifting of various workpiece components. Such apparatus is exemplified in U.S. Pat. No. 4,886,244 to Renault wherein a hydraulic jack structure utilizing a reciprocatably jaw is lifted relative to a base, wherein the jaw structure positioned above the base is arranged for lifting low-lying objects, as opposed to the instant invention wherein the jack structure includes the base aligned with an associated jaw for lifting of extremely low-lying objects.

U.S. Pat. No. 4,461,456 to Munna sets forth a hydraulic ramp structure, wherein a hydraulic jack lifts an upper plate relative to a lower plate.

U.S. Pat. No. 3,647,183 to Rishovd sets forth a vehicle jack, wherein a jaw member is lifted relative to a carriage structure.

As such, it may be appreciated that there continues to be a need for a new and improved jack adapter apparatus as set forth by the instant invention which addresses both the problems of ease of use as well as effectiveness in construction in permitting lifting of workpiece structure from a relative zero ground lever and in this respect, the present invention substantially fulfills this need.

SUMMARY OF THE INVENTION

In view of the foregoing disadvantages inherent in the known types of jack apparatus now present in the prior art, the present invention provides a jack adapter apparatus wherein the same arranges a plate relative to a hydraulic jack to permit lifting of various workpiece components. As such, the general purpose of the present invention, which will be described subsequently in greater detail, is to provide a new and improved jack adapter apparatus which has all the advantages of the prior art jack apparatus and none of the disadvantages.

To attain this, the present invention provides a generally "S" shaped plate member arranged for securement to a rod head plate of a rod that is extensibly and telescopingly mounted within a jack cylinder. The plate member is formed of a first plate, a second medial plate, and a third top plate, wherein the third top plate includes clamping structure to secure the third plate relative to the rod head plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved jack adapter apparatus which has all the advantages of the prior art jack apparatus and none of the disadvantages.

It is another object of the present invention to provide a new and improved jack adapter apparatus which may be easily and efficiently manufactured and marketed.

It is a further object of the present invention to provide a new and improved jack adapter apparatus which is of a durable and reliable construction.

An even further object of the present invention is to provide a new and improved jack adapter apparatus which is susceptible of a low cost of manufacture with regard to both materials and labor, and which accordingly is then susceptible of low prices of sale to the consuming public, thereby making such jack adapter apparatus economically available to the buying public.

Still yet another object of the present invention is to provide a new and improved jack adapter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of a modification of the adapter apparatus of the invention FIG. 5 is an orthographic view, taken along the lines 5—5 of FIG. 4 in the direction indicated by the arrows.

FIG. 6 is an isometric illustration of a modification of the jack adapter apparatus strap structure.

FIG. 7 is an orthographic side view of the further modification of the invention.

FIG. 8 is an orthographic rear view of the apparatus illustrated in FIG. 7.

FIG. 9 is an orthographic bottom view of the apparatus as set forth in FIG. 7.

FIG. 10 is an orthographic side view of a fastener structure utilized by the invention.

FIG. 11 is an orthographic bottom view of the structure fastener as illustrated in FIG. 10.

DESCRIPTION OF THE PREFERRED EMBODIMENT

Figure 1:
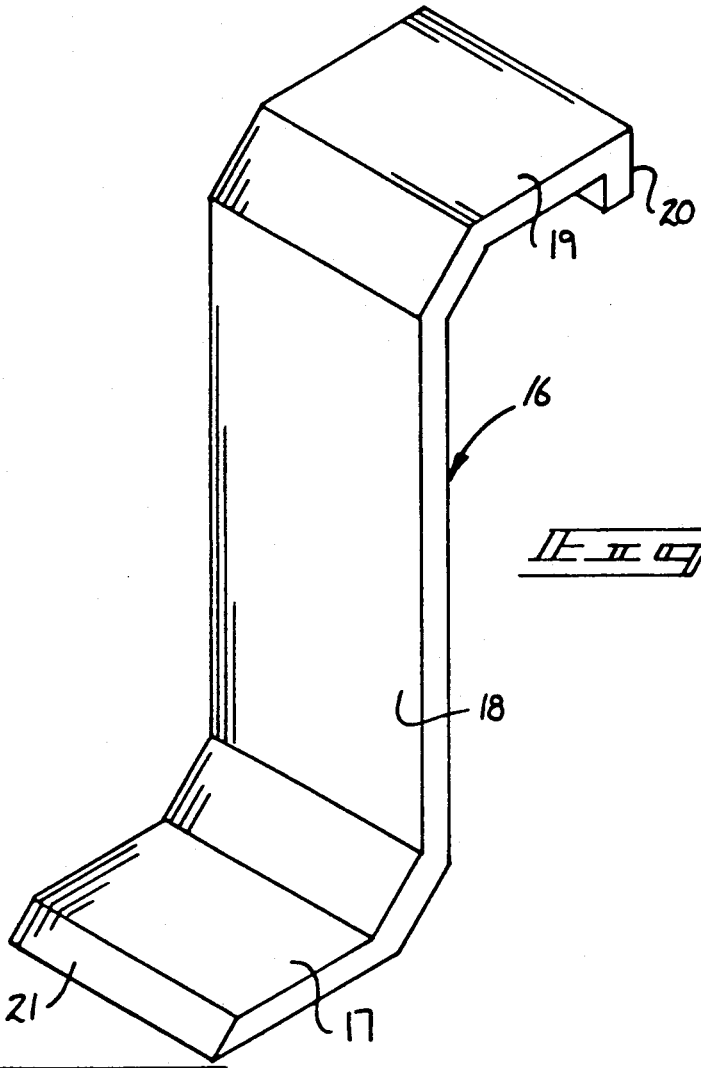
FIG. 1 is an isometric illustration of the instant invention.
Figure 2:
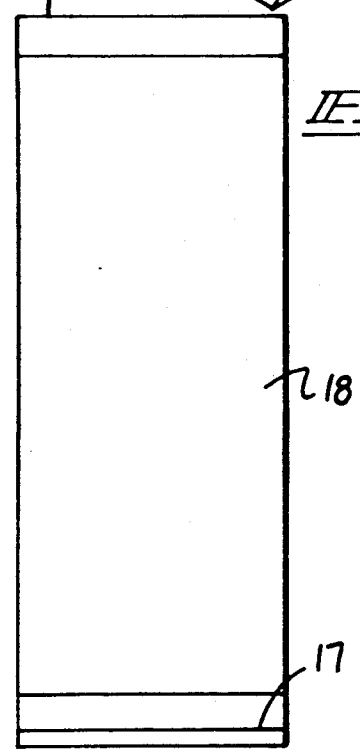
FIG. 2 is an orthographic frontal view of the invention.
Figure 3:
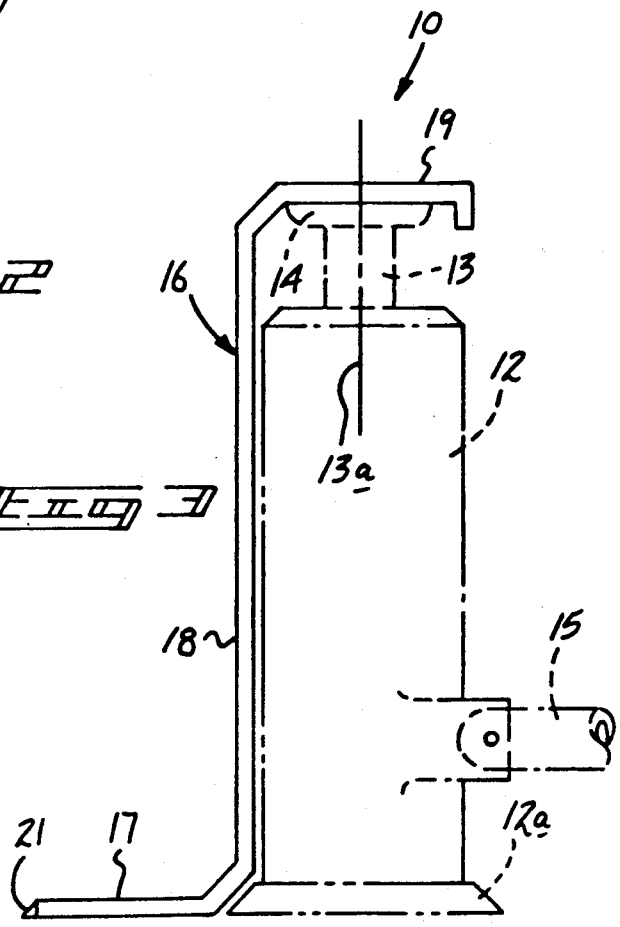
FIG. 3 is an orthographic side view of the instant invention in association with a hydraulic jack.
Figure 12:
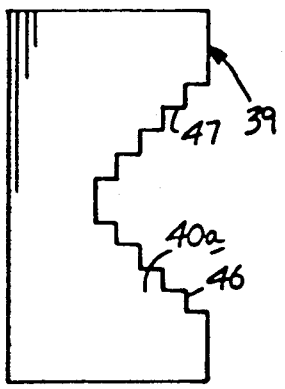
FIG. 12 is an orthographic bottom view of a clamp plate utilized by the invention
Figure 13:
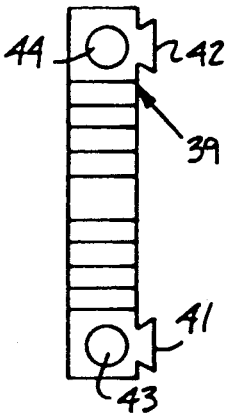
FIG. 13 is an orthographic end view of the clamp plate structure as illustrated in FIG. 12.
Figure 14:
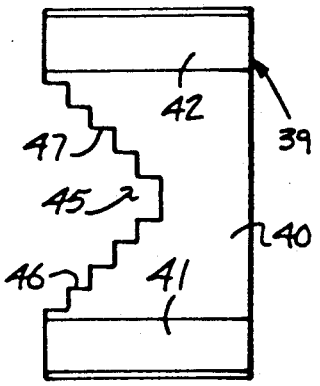
FIG. 14 is an orthographic top view of the clamp plate structure of FIG. 12.

With reference now to the drawings, and in particular to FIGS. 1 to 15 thereof, a new and improved jack adapter apparatus embodying the principles and concepts of the present invention and generally designated by the reference numeral 10 will be described.

More specifically, the jack adapter apparatus 10 of the instant invention essentially comprises a hydraulic jack structure 11 defined by a jack cylinder 12, with a base 12*a* orthogonally mounted relative to a central jack axis 13*a*. An extensible rod 13 is extensibly and retractably mounted relative to the jack cylinder 12 to project coaxially relative to the central jack axis 13*a* and with the rod 13 to include a rod head plate 14. A jacking lever 15 is provided to effect selective reciprocation of the extensible rod 13. An adapter assembly 16 is provided of a generally "S" shaped configuration taken in profile defined by a first plate 17 orthogonally and fixedly mounted to a lower terminal end of a second plate 18, with an upper terminal end of the second plate 18 orthogonally oriented and fixedly secured to a third plate 19. The third plate 19 includes a containment flange 20 oriented parallel to the second plate 18 and spaced therefrom to receive and position the red head plate 14 between the containment flange 20 and the second plate 18. Typically, a first plate beveled forward surface 21 is provided to permit ease of projection of the first plate 17 under a relatively low-lying workpiece to be lifted, with the first plate 17 aligned with the jack base 12*a* in a first position, wherein the first plate 17 is lifted and elevated relative to the jack base 12*a* in a second position.

The second plate 18 includes a plurality of columns of mounting bores defined by a predetermined diameter, with each mounting bore 22 to receive a resilient plug head 23, with each plug head including a plug head base 24 defined by a diameter equal to the predetermined diameter to be securely received within an associated mounting bore 22. In this manner, marring of a workpiece to be lifted is essentially eliminated. The adapter assembly 16, as illustrated in FIG. 6, includes a plurality of first plates 17 extending downwardly from the second plate 18, wherein the second plate 18 includes a bifurcated second plate lower leg portion 26, wherein each leg of the bifurcated leg portion mounts fixedly a first plate 17 thereto.

Figure 15:
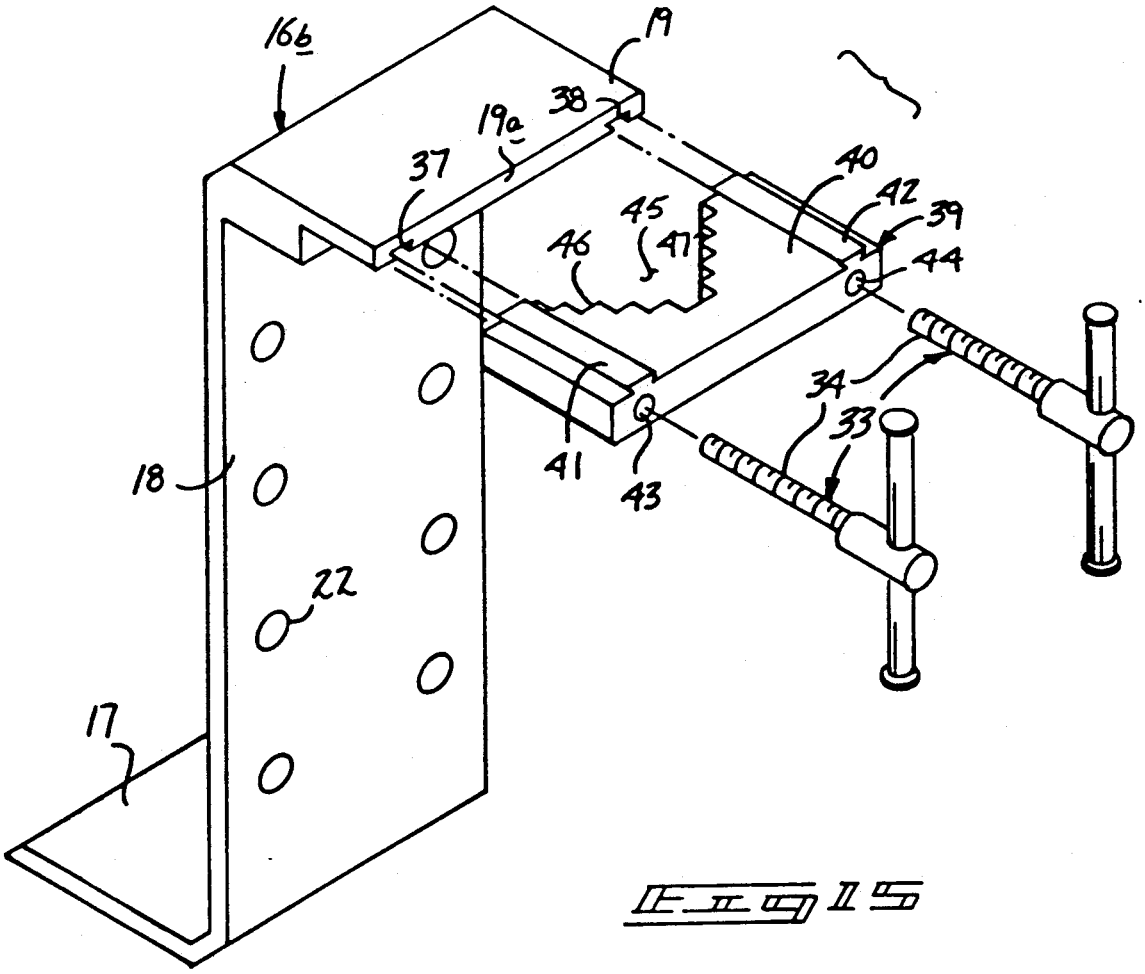
FIG. 15 is an isometric illustration of the further modified clamp plate structure utilized by the invention of FIGS. 7-14.

The FIGS. 7-15 illustrate a further modified adapter assembly 16 to include a third plate bottom surface 27 formed to a bottom surface of the third plate 19, that includes spaced parallel abutment bosses defined by a respective first and second abutment boss 28 and 29. Each abutment boss includes a confronting and respective first and second stepped interior surface 28*a* and 29*a* (see FIG. 9 for example) to receive in an adjustable manner the rod head plate 14 therebetween. Accordingly, a stepped "V" shaped recess 30 is defined between the first and second interior surfaces 28*a* and 29*a* and further, each respective first and second abutment boss 28 and 29 includes a respective internally threaded first and second bore 31 and 32 respectively. The first and second bores are arranged in a parallel relationship relative to one another, to each include and receive a threaded shank 34 of an associated fastener member 33, as illustrated in FIG. 10. Each fastener member 33 includes a head shank 35 coaxially aligned and fixedly mounted to an upper terminal end of the threaded shank 34, with a fastener rod 36 orthogonally directed through the head shank 35 to permit ease of manual rotation of the fastener member 33 relative to each respective bore 31 and 32. A respective first and second dove tail groove 37 and 38 is projected into the third plate 19, with each respective first and second groove 37 and 38 positioned above and forwardly of the first and second abutment boss 28 and 29 directed interiorly of the third plate through a rear end surface 19*a* thereof Received within the first and second dove tail grooves 37 and 38 are respective first and second dove tail tongue 41 and 42 mounted fixedly and in parallel relationship relative to a clamp plate planar surface 40 of an associated clamp plate 39. The first and second dove tail tongues 41 and 42 are spaced apart a predetermined spacing equal to a predetermined spacing defined between the first and second dove tail grooves 37 and 38. The clamp plate 39 further includes a first and second fastener receiving bore 43 and 44 positioned longitudinally through the clamp plate 39 below and coextensively with the respective first and second dove tail tongues 41 and 42. In this manner, the first and second fastener receiving bores 43 and 44 receive the threaded shanks 34 of each fastener member 33 therethrough for reception within respective internally threaded first and second bores 31 and 32. A clamp plate forward "V" shaped recess 45 is defined between second and third stepped surfaces 46 and 47 in a confronting relationship relative to one another and defined between the first and second fastener receiving bores 43 and 44. Accordingly, a fastener member 33 is directed through each receiving bore 43 and 44 for reception into a respective internally threaded first bore 31 and 32 to permit engagement of the clamp plate forward "V" shaped 45 with the stepped "V" shaped recess 30 to thereby capture the jack members rod head plate 14 therebetween to provide a stable and secure association of the hydraulic jack 11 and the adapter assembly 16*b*, as illustrated in FIG. 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jack adapter apparatus, comprising:

a hydraulic jack member, the hydraulic jack member including a jack cylinder coaxially aligned along a central jack axis, and a jack base fixedly and orthogonally mounted to a lower terminal end of the jack cylinder, and an extensible rod telescopingly mounted from within the jack cylinder through a top surface of the jack cylinder, and the extensible rod including a rod head plate, and an adapter assembly arranged for mounting to the rod head plate, the adapter assembly including a first plate, the first plate orthogonally oriented relative to the central jack axis, the first plate fixedly and orthogonally oriented relative to a second plate, and the second plate extending parallel relative to the central jack axis, and a third plate fixedly and orthogonally mounted to an upper terminal end of the second plate arranged parallel relative to the first plate, wherein the first plate is arranged adjacent the jack base in a first position and extends above the jack base in a second position upon elevation of the rod head plate, and the first plate includes a first plate beveled forward surface to permit projection of the first plate below a workpiece to be lifted, and the third plate includes a plurality of mounting bores directed therethrough, the mounting bores each including a resilient plug head, each plug head including a resilient plug base, and each base defined by a predetermined diameter, and each mounting bore defined by an equal predetermined diameter to securely receive each plug base within each respective mounting bore, and the third plate includes a third plate bottom surface, the third plate bottom surface including a first abutment boss spaced from and parallel a second abutment boss, the first abutment boss and the second abutment boss each including a respective first and second stepped interior surface in confronting relationship relative to one another to receive the rod head plate therebetween defining a stepped "V" shaped recess to receive the rod head plate, and each said first and second abutment boss including a respective first and second internally threaded bore, each first and second internally threaded bore arranged parallel relative to one another spaced apart a predetermined spacing, and a clamp plate, the clamp plate including a first and second fastener receiving bore directed longitudinally of the clamp plate, wherein the first and second fastener receiving bores are arranged at a parallel relationship relative to one another spaced apart the predetermined spacing, and a fastener member directed through the fastener receiving bore and received within a respective internally threaded bore of said first and second bores to secure the clamp plate to the third plate bottom surface.

2. An apparatus as set forth in claim 1 wherein the clamp plate includes a planar top surface, the planar top surface including a first and second dove tail tongue projecting above the planar top surface, the first and second dove tail tongue spaced apart the predetermined spacing, and the third plate bottom surface including a respective first and second dove tail groove directed within the third plate bottom surface spaced forwardly of and above the respective first and second abutment boss, wherein the first and second dove tail groove spaced apart the predetermined spacing slidably receives the respective first and second dove tail tongue.

3. An apparatus as set forth in claim 2 wherein the clamp plate includes a clamp plate forward "V" shaped recess, the clamp plate forward "V" recess is in confronting relationship relative to the stepped "V" shaped recess to secure the rod head plate between the clamp forward "V" shaped recess and the stepped "V" shaped recess.

4. An apparatus as set forth in claim 3 wherein the first and second dove tail grooves are directed through a rear end surface of the third plate and spaced above the first and second abutment boss.

* * * * *